US008762136B2

(12) United States Patent
Chathoth et al.

(10) Patent No.: US 8,762,136 B2
(45) Date of Patent: Jun. 24, 2014

(54) SYSTEM AND METHOD OF SPEECH COMPRESSION USING AN INTER FRAME PARAMETER CORRELATION

(75) Inventors: Sooraj Kovoor Chathoth, Yelechanahalli (IN); Kumar U. Phani, Ongole (IN); Ganesh Guddanti, Vidyaranyapura (IN)

(73) Assignee: LSI Corporation, Milpitas, CA (US)

( * ) Notice: Subject to any disclaimer, the term of this patent is extended or adjusted under 35 U.S.C. 154(b) by 443 days.

(21) Appl. No.: 13/099,956

(22) Filed: May 3, 2011

(65) Prior Publication Data

US 2012/0284020 A1 Nov. 8, 2012

(51) Int. Cl.
*G10L 19/00* (2013.01)

(52) U.S. Cl.
USPC ..... 704/219; 704/221; 704/223

(58) Field of Classification Search
USPC ..... 704/229–230, 500–504, 219–225; 375/245, 259
See application file for complete search history.

(56) References Cited

U.S. PATENT DOCUMENTS

| | | | | |
|---|---|---|---|---|
| 5,778,338 | A * | 7/1998 | Jacobs et al. | 704/223 |
| 6,154,499 | A * | 11/2000 | Bhaskar et al. | 375/259 |
| 7,336,713 | B2 * | 2/2008 | Woo et al. | 375/245 |
| 7,499,853 | B2 * | 3/2009 | Yoshida et al. | 704/219 |
| 2010/0174547 | A1 | 7/2010 | Vos | |

FOREIGN PATENT DOCUMENTS

WO 2004090864 A2 10/2004

* cited by examiner

*Primary Examiner* — Huyen X. Vo

(57) ABSTRACT

The disclosure provides a speech encoder, decoder, speech processor and methods of encoding and decoding speech. In one embodiment, the speech encoder includes: (1) a speech frame generator configured to form a speech frame from an input speech signal, the speech frame having a length of multiple samples, (2) a speech frame processor configured to determine if the speech frame is a subsequent voiced frame of a group of consecutive voiced frames and, based thereon, perform speech analysis of the subsequent voiced frame; and (3) a speech frame coder configured to perform, if the speech frame is a subsequent voiced frame, differential coding of speech parameters of the subsequent voiced frame with respect to previous speech parameters of the previous voiced frame of the consecutive voiced frames.

20 Claims, 4 Drawing Sheets

SYSTEM AND METHOD OF SPEECH COMPRESSION USING AN INTER FRAME PARAMETER CORRELATION

TECHNICAL FIELD

This application relates to, in general, digitally representing speech signals and, more specifically, to speech coding.

BACKGROUND

Speech coding or speech compression relates to obtaining digital representation of a speech signal that can be used for digital transmission and storage of the speech signal. Typical speech coding schemes aim at storing or transmitting a speech signal with a minimal number of bits while maintaining the quality of the signal. An ideal coded speech signal has a low bit rate, high perceived quality, low complexity and low signal delay.

Speech coding methods can be broadly classified into waveform coding, vocoding and hybrid coding. Waveform coding is done by producing a reconstructed signal, whose waveform very much resembles the original speech waveform, without assuming any properties of the speech signal. This is done on a sample by sample basis. Various time domain waveform coding schemes are Pulse Code Modulation (PCM), APCM (Adaptive PCM), DPCM (Differential PCM), and ADPCM (Adaptive Differential PCM).

Vocoding is a general compression scheme for low bit rate speech coding and mainly depends on the voice generated. In vocoding, parameters of the vocal tract filter which are stored or transmitted to a decoder are extracted and the speech is then synthesized at the decoder using these parameters. Linear Predictive Coding (LPC), formant coders and phase vocoders are examples of vocoding. Another vocoding example is the U.S. government LPC algorithm (LPC-10) that is used for military applications operating at 2.4 Kbps.

Hybrid coding makes use of techniques used in both waveform coding and vocoding to achieve good quality speech at a reasonable bit rate. Hybrid coders, however, can be complex and computationally expensive. Hybrid coding uses a linear prediction source filter model of a speech production system. Typically, in the hybrid coding, analysis of a speech frame is done by synthesizing the same at the encoder to select an excitation signal by trying to minimize the error between the reconstructed speech waveform and the original speech waveform. Hybrid coders are broadly classified as Analysis by Synthesis (Abs) coders. Code Excited Linear Prediction (CELP) codecs, Algebraic CELP (ACELP), Conjugate Structure ACELP (CS-ACELP) codecs are examples of the hybrid codec category.

SUMMARY

In one aspect, the disclosure provides a speech encoder. In one embodiment, the speech encoder includes: (1) a speech frame generator configured to form a speech frame from an input speech signal, the speech frame having a length of multiple samples, (2) a speech frame processor configured to determine if the speech frame is a subsequent voiced frame of a group of consecutive voiced frames and, based thereon, perform speech analysis of the subsequent voiced frame; and (3) a speech frame coder configured to perform, if the speech frame is a subsequent voiced frame, differential coding of speech parameters of the subsequent voiced frame with respect to previous speech parameters of the previous voiced frame of the consecutive voiced frames.

In another aspect, the disclosure provides a decoder. In one embodiment, the decoder includes: (1) a speech sample generator configured to generate multiple speech samples based on a synthesized speech signal, (2) a speech synthesizer configured to generate the synthesized speech signal from an excitation signal and LPC parameters associated with a subsequent voiced frame of a group of consecutive voiced frames and (3) a digital speech analyzer configured to perform differential decoding of an encoded bit stream of the subsequent voiced frame to determine the excitation signal and the LPC parameters.

In yet another aspect, the disclosure provides a speech processor. In one embodiment, the speech processor includes: (1) an encoder having a speech frame coder configured to perform differential coding of speech parameters of a subsequent voiced frame of a group of consecutive voiced frames, the differential coding based on previous speech parameters of the previous voiced frame of the consecutive voiced frames and (2) a decoder configured to perform differential decoding of an encoded bit stream of a received voiced frame to generate speech samples.

In still a different aspect, the disclosure provides a method of encoding a speech frame. In one embodiment, the method of encoding includes: (1) determining if a speech frame is a subsequent voiced frame of a group of consecutive voiced frames, (2) if the speech frame is a subsequent voiced frame, providing differentially coded speech parameters of the subsequent voiced frame with respect to previous speech parameters of the previous voiced frame of the consecutive voiced frames, (3) entropy coding the differentially coded speech parameters and (4) generating an encoded bit stream based on the entropy coding.

In yet still another aspect, the disclosure provides method of decoding an encoded bit stream. In one embodiment, the method of decoding includes: (1) determining if an encoded bit stream includes a subsequent voiced frame of a group of consecutive voiced frames, (2) performing entropy decoding of the subsequent voiced frame based on the determining, (3) performing differential decoding of the subsequent voiced frame based on the entropy decoding and (4) generating multiple speech samples of the subsequent voiced frame based on the entropy and differential decoding.

BRIEF DESCRIPTION

Reference is now made to the following descriptions taken in conjunction with the accompanying drawings, in which.

DETAILED DESCRIPTION

The disclosure provides a method and system of speech compression using inter frame speech parameter correlation.

As disclosed in one embodiment, speech compression is achieved by applying differential coding on speech parameters, such as, pitch period and gain. The differentially coded speech parameters are then entropy coded. As such, the disclosure provides a speech compression technique that can reduce the number of bits required to represent speech frames. Additionally, speech compression complexity can be reduced by limiting codebook search of a current speech frame to a region close to an index of the codebook entry of the previous speech frame.

Accordingly, the disclosed speech coding techniques recognize that non-removal of parameter redundancy in the compressed domain can result in a poor compression rate. Thus, the disclosed conventional speech coders consider temporal parameter redundancy in the compressed domain and employ the correlation of various encoder parameters between adjacent speech frames. By compressing the speech signal using interframe parameter correlation, the bits required to represent frame data associated with the speech frame can be reduced. The frame data includes speech parameters and codebook indices information of the speech frame. The disclosed coding techniques can be applied to fixed rate or variable rate speech codecs.

Figure 1:
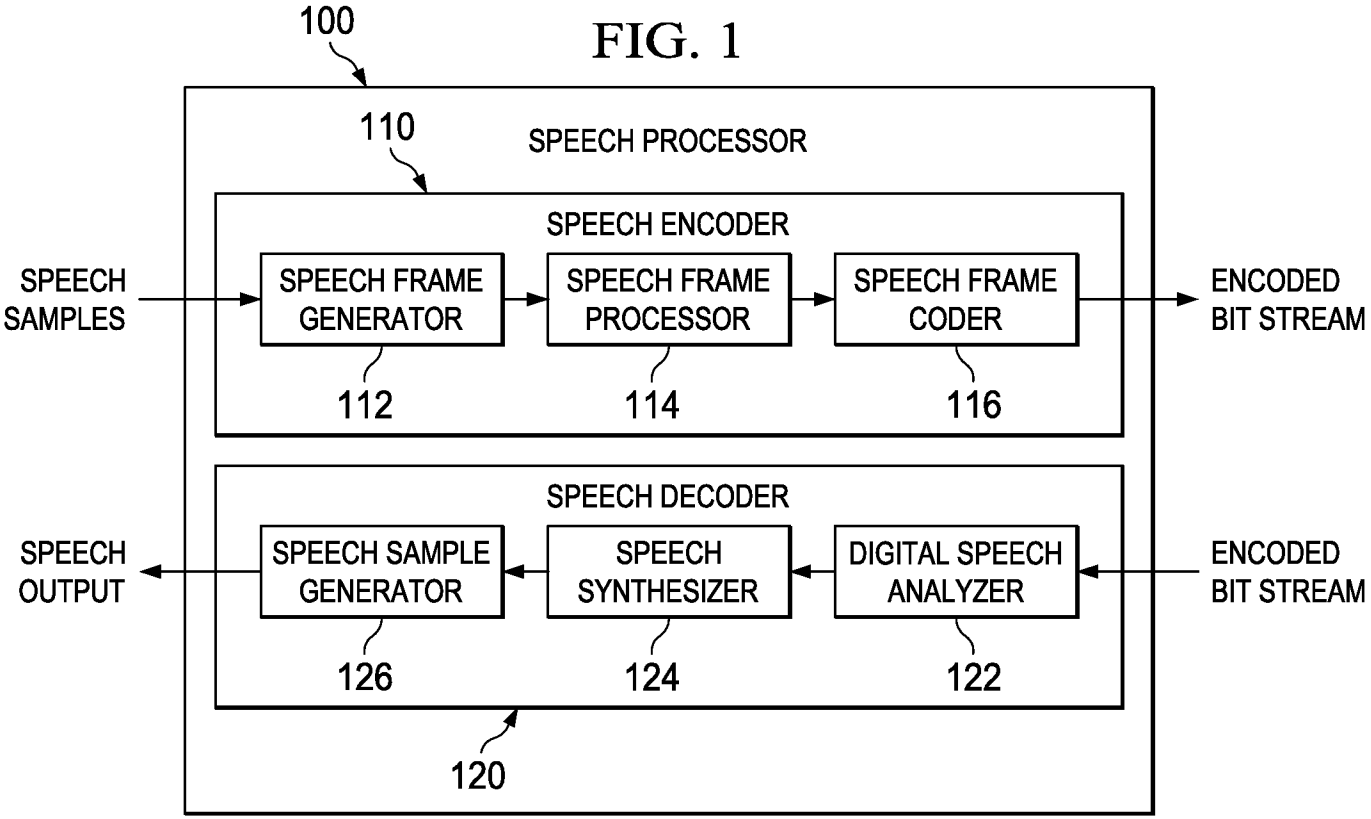
FIG. 1 illustrates a block diagram of an embodiment of a speech processing system constructed according to the principles of the disclosure.
Figure 2:
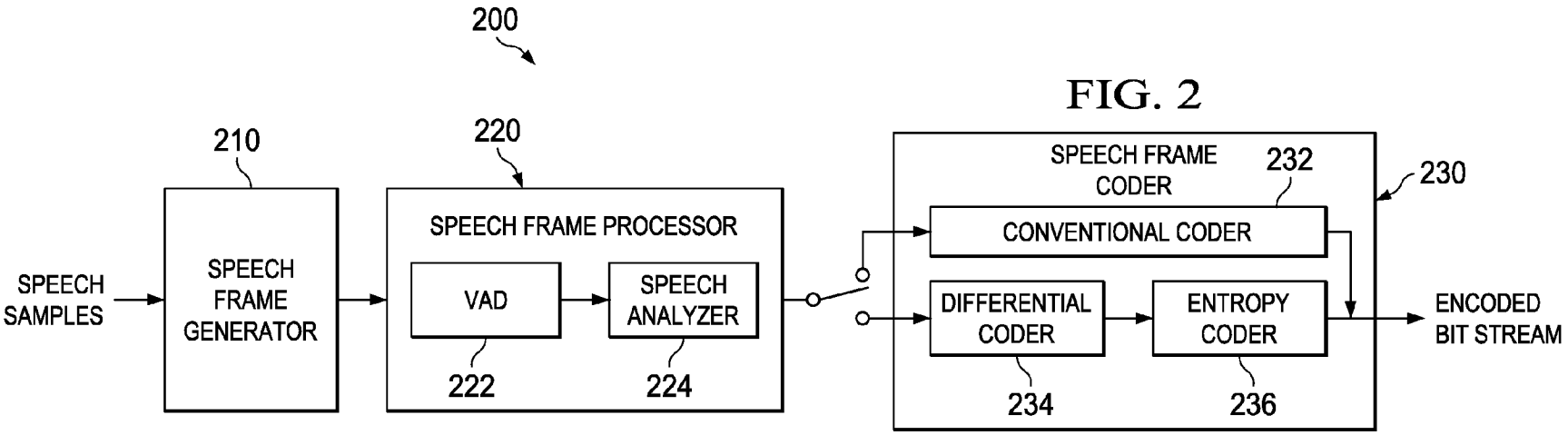
FIG. 2 illustrates a block diagram of an embodiment of an encoder constructed according to the principles of the disclosure.
Figure 3:
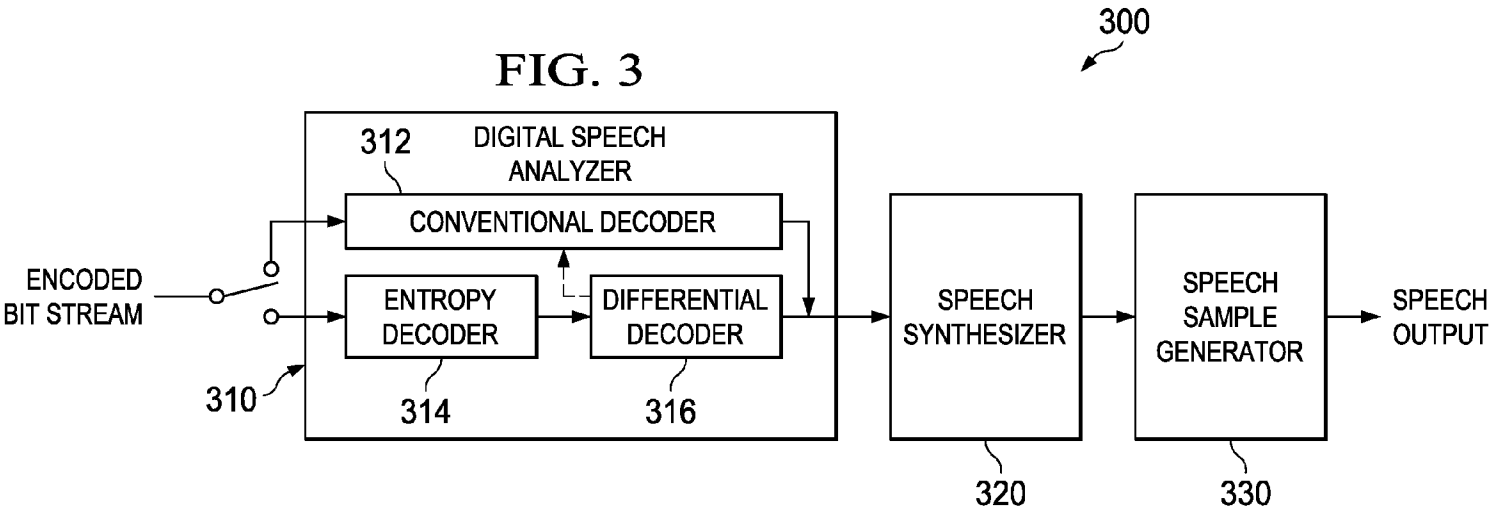
FIG. 3 illustrates a block diagram of an embodiment of a decoder constructed according to the principles of the disclosure.

FIG. 1 illustrates a block diagram of an embodiment of a speech processor 100 constructed according to the principles of the disclosure. The speech processor 100 is configured to encode speech into a digital representation that can be used, for example, for digital transmission or storage. Additionally, the speech processor 100 is configured to decode a digital representation of speech to provide speech output. In one embodiment, the speech processor 100 may be part of a mobile station or network. In another embodiment, the speech processor 100 may be part of a computer or a computing system. The speech processor 100 includes a speech encoder 110 and a speech decoder 120. A more detailed embodiment of a speech encoder and a speech decoder are illustrated in FIG. 2 and FIG. 3, respectively.

The speech encoder 110 is configured to receive an input speech signal and generate an encoded bit stream representing the speech signal. The input speech signal may be received from a conventional microphone. For example, the microphone may be a microphone of a telephone, such as a mobile telephone, or a microphone associated with a laptop computer, such as a built-in or auxiliary microphone.

A speech frame generator 112 is configured to receive the input speech signal and, therefrom, form a speech frame. Typically, the input speech signal is speech samples obtained from a microphone. In one embodiment, the speech samples are pulse code modulation (PCM) speech samples obtained from the microphone. The speech frame formed by the speech frame generator 112 includes multiple speech samples. Accordingly, the generated speech frame has a length of multiple speech samples, such as PCM speech samples.

A speech frame processor 114 is configured to receive the speech frame from the speech frame generator 112 and perform speech analysis of the speech frame. The speech frame processor 114 may first determine if the speech frame includes voice activity. If voice activity is detected in the speech frame (i.e., a voiced frame), the speech frame processor 114 is then configured to determine if the voiced frame is a subsequent voiced frame or, alternatively, a first voiced frame.

If the speech frame processor 114 determines the voiced frame is a subsequent voiced frame, the subsequent voiced frame is analyzed and coded according to the embodiments of the disclosure. For example, the speech frame processor 114 may extract speech parameters and perform a limited codebook search for a subsequent speech frame during speech analysis. The speech frame processor 114 may employ a previous voiced frame codebook index to perform the limited search. Additionally, the speech frame processor 114 may be configured to generate a current voiced frame index that can then be used as the previous voiced frame index for the next voiced frame of the group of consecutive voiced frames. The speech frame processor 114 may analyze the non-voiced frame or the first voiced frame according to conventional speech analysis. Thus, the speech frame processor 114 is configured to perform speech analysis of a speech frame based on determining if the speech frame is a non-voiced framed, a first voiced frame or a subsequent voiced frame of a group of consecutive voiced frames.

A speech frame coder 116 is configured to perform coding of the speech frame. For the non-voiced frame or the first voiced frame, the speech frame coder 116 may code the voiced frame according to conventional coding methods or techniques. For a subsequent voiced frame, the speech frame coder 116 is configured to perform differential coding of the extracted speech parameters with respect to previous speech parameters of the previous voiced frame of the consecutive voiced frames. The speech frame coder 116 is then configured to perform entropy coding of the differentially coded parameters.

Typically, the speech encoder 110 will generate multiple speech frames from the input speech signal. The speech frame coder 116 is configured to combine all of the speech frames, including non-voiced frames, first voiced frames and subsequent voiced frames, to generate an encoded bit stream of the input speech signal.

The speech decoder 120 includes a digital speech analyzer 122 that is configured to differentially decode portions of an encoded bit stream of an audio signal. The encoded bit stream is received via a speech encoder constructed according to the principles of the speech encoder 110. As such, the encoded bit stream includes encoded subsequent voiced frames. Accordingly, the digital speech analyzer 122 is configured to perform differential decoding of the encoded bit stream portions of subsequent voiced frames. Additionally, the digital speech analyzer 122 is configured to perform entropy decoding of the differentially decoded bit stream sections. From the decoding, an excitation signal and voice parameters are determined.

A speech synthesizer 124 is configured to receive the excitation signal and voice parameters from the digital speech analyzer 122 and, therefrom, generate a synthesized speech signal. A speech sample generator 126 is configured to generate multiple speech samples based on the synthesized speech signal. The speech decoder 120, therefore, is configured to decode an encoded bit stream having an encoded portion that may include at least one subsequent voiced frame. For other portions of the encoded bit stream, i.e., those parts that include encoded non-voiced frames and first voiced frames, the speech decoder 120 may operate as a conventional speech decoder.

FIG. 2 illustrates a block diagram of an embodiment of a speech encoder 200 constructed according to the principles of the disclosure. The speech encoder 200 includes a speech frame generator 210, a speech frame processor 220 and a speech frame coder 230.

The speech frame generator 210 obtains speech samples, such as PCM samples, from a microphone and generates a speech frame based thereon. In one embodiment, a speech frame of M samples in length is formed using the obtained speech samples, wherein M is an integer. One skilled in the art will understand the operation and configuration of a speech frame generator.

The speech frame processor 220 receives the speech frame from the speech frame generator 210. The speech frame processor 220 includes a voice activity detector (VAD) 222 and a speech analyzer 224. The VAD 222 determines if there is any voice activity in the speech frame and the speech analyzer 224 performs speech analysis on the speech frame. The VAD 222 may be a conventional voice activity detector that is used with voice processing systems.

If the VAD does not detect voice activity, the speech frame is considered a non-voiced frame. If the VAD detects voice activity, then the speech frame is considered a voiced frame. The speech analyzer 224 receives a non-voiced frame and a voiced frame for speech analysis. If a non-voiced frame, the speech analyzer 224 is configured to perform conventional speech analysis and forward the non-voiced frame to the speech frame coder 230 for coding. If a voiced frame, the speech analyzer 224 determines if the voiced frame is a first voiced frame of a group of consecutive voiced frames or if the voiced frame is a subsequent voiced frame of the group. If a first voiced frame, the speech analyzer 224 is configured to perform conventional speech analysis and forward the first voiced frame to the speech frame coder 230 for coding.

When the speech analyzer 224 determines that the voiced frame is a subsequent voiced frame, the speech analyzer 224 is configured to extract speech parameters from the subsequent voiced frame and perform a codebook search for the subsequent voiced frame in a localized search region of the codebook that is proximate the region of the previous voiced frame of the group of consecutive voiced frames. If, for example, the subsequent voiced frame is the second voiced frame of the group, the previous voiced frame would be the first voiced frame. A group of consecutive voiced frames is a series of contiguous voiced frames.

The speech analyzer 224 is also configured to index a region of the codebook to obtain a codebook index for the current voiced frame being processed, i.e., the subsequent voiced frame. The index may be of proximate regions of the codebook with respect to the current voiced frame. In some embodiments, the index may associate adjacent regions of the codebook with the index. In one embodiment, the codebook entries are so arranged that codebook index of the subsequent voiced frame lies in the proximate region of that of the previous voiced frame.

The speech frame coder 230 is configured to receive the analyzed speech frames, whether a non-voiced frame, a first voiced frame or a subsequent voiced frame, and code the received frame into an encoded bit stream. If the received frame is a non-voiced frame or a first voiced frame, then a conventional coder 232 of the speech frame coder 230 is employed to code the frame. If the received speech frame is a subsequent voiced frame, a differential coder 234 and an entropy coder 236 are employed to code the frame. The differential coder 234 is configured to perform differential coding of the speech parameters based on the parameters of the previous voiced frame. The entropy coder 236 is configured to perform entropy coding of the differentially coded speech parameters. The speech frame coder 230 combines the speech frames to generate an encoded bit stream.

FIG. 3 illustrates a block diagram of an embodiment of a speech decoder 300 constructed according to the principles of the disclosure. The speech decoder 300 includes a digital speech analyzer 310, a speech synthesizer 320 and a speech sample generator 330.

The digital speech analyzer 310 is configured to receive and decode an encoded bit stream. If the encoded bit stream corresponds to a non-voiced frame or a first voiced frame, then the encoded bit stream is decoded by the conventional decoder 312. As such, the conventional decoder 312 is configured to extract an excitation signal associated with the encoded bit stream and forward the excitation signal to the speech synthesizer 320 for processing.

If the encoded bit stream corresponds to a subsequent voiced frame, the digital speech analyzer 310 employs the entropy decoder 314 and the differential decoder 316 to decode. The entropy decoder 314 is configured to perform entropy decoding of the bit stream to obtain associated parameters. In one embodiment, the entropy decoder 314 is a Huffman entropy decoder.

The differential decoder 316 is configured to perform differential decoding of the entropy decoded parameters based on the parameters of the previous voiced frame. As such, employing the entropy decoder 314 and the differential decoder 316, the speech decoder 300 generates individual current pitch period based on the previous pitch period. The same technique is applied to the parameter gain of the subsequent voiced frames. From the parameters, the differential decoder 316 extracts an excitation signal associated with the current encoded voiced frame employing the associated codebook index. The codebook index may be a previous voiced frame codebook index.

The speech synthesizer 320 is configured to synthesize a speech signal from the extracted parameters received from the digital speech analyzer 310. The speech sample generator 330 is then configured to generate multiple samples on the speech synthesis to provide a speech output signal. The speech synthesizer 320 and the speech sample generator 330 may be conventional components.

Figure 4:
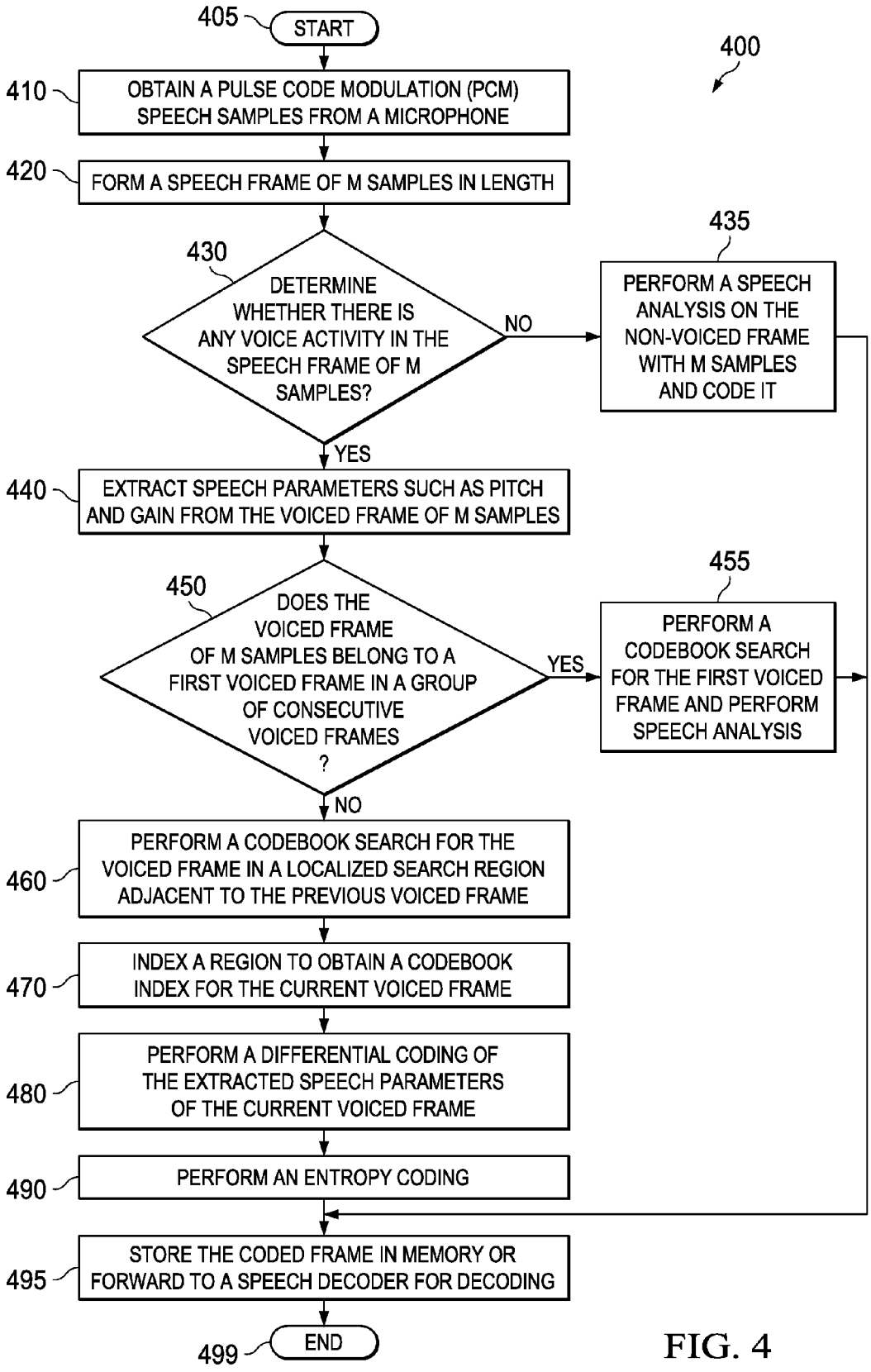
FIG. 4 illustrates a flow diagram of an embodiment of a method of encoding speech carried out according to the principles of the disclosure.

FIG. 4 illustrates a flow diagram of an embodiment of a method 400 of encoding speech carried out according to the principles of the disclosure. The method 400 employs speech compression using inter frame parameter correlation. An encoder, such as the speech encoder 110 of FIG. 1 or the speech encoder 200 of FIG. 2, may be configured to perform the method 400. As such, the speech encoder 110 and the speech encoder 200 may include the necessary circuitry, software, firmware, etc., to perform the steps of the method 400. The method 400 starts in a step 405.

In a step 410, pulse code modulation (PCM) audio samples are obtained from a microphone. The microphone may be a component of a mobile phone. In another embodiment, the microphone may be a component of a computer.

An audio frame of M samples in length is formed in a step 420 using the obtained PCM audio samples. M may be selected based on a particular implementation of the method 400. In one embodiment, M may be in a range of 80 to 320. The value or range of M may change with different implementations and with different equipment.

In a first decisional step 430, a determination is made if there is any voice activity in the audio frame of M samples that was formed. A conventional voice activity detector may be used to determine the presence of voice activity in the audio frame. If voice activity is not detected in the audio frame, then the method 400 proceeds to step 435 where speech analysis is performed on the audio frame (i.e., the non-voiced frame with M samples). As one skilled in the art will understand, speech analysis can be finding LPC parameters, energy calculations, etc. The non-voiced frame with M samples is then coded in step 435. A conventional coding technique, such as, waveform coding, vocoding or hybrid coding, may be used for coding the non-voiced frame. The method 400 then proceeds to step 495.

If voice activity is determined to be present in step 430, then the audio frame is a speech frame and the method 400 proceeds to step 440. In step 440, speech parameters, such as pitch and gain, are extracted from the speech frame of M samples. To extract the speech parameters, conventional autocorrelation algorithms may be employed.

A determination is then made in a second decisional step 450 whether the voiced frame of M samples belongs to a first voiced frame in a group of consecutive voiced frames. A counter may be used to indicate if the voiced frame is a first voiced frame. In one embodiment, whenever a transition occurs from a non-voiced frame to a voiced frame, a counter may be initialized to zero. The counter then can be incremented for the subsequent voiced frames.

If the voiced frame is a first frame, then the method 400 continues to step 455 where a codebook search is performed for the first voiced frame. In addition, speech analysis is performed on the first voiced frame in the step 455. The codebook search may be performed using a conventional technique. One skilled in the art will understand the codebook searching and speech analysis. After step 455, the method 400 continues to step 495.

Returning now to the second decisional step 450, if the voiced frame is determined to not be a first frame, then the method 400 continues to a step 460. In step 460, a codebook search for the voiced frame is performed in a localized search region adjacent to the previous voiced frame codebook index. The previous voiced frame codebook index is obtained from step 455 for the first voiced frame in the group of consecutive voiced frames. For subsequent voiced frames, the previous voiced frame codebook index is obtained from step 470.

In step 470, a region is indexed to obtain a voiced frame codebook index for the current voiced frame. In one embodiment, for each index in a proximate region, a look-up is performed in the codebook table to get the code vector, synthesize a speech frame and compute the error between the synthesized speech frame and original speech frame. The index that results in minimum error can be selected as the index of that frame.

The method 400 then continues to step 480 where a differential coding of the extracted speech parameters of the voiced frame of length M is performed. In one embodiment, the differential coding may be applied to a group of consecutive voiced frames to get a better compression rate. For example, the differential coding may be performed using the equation:

$$E_i = X_i - X_{i-1}$$

where $E_i$ is the error associated with the $i^{th}$ voiced frame, $X_i$ is the speech parameter for the $i^{th}$ speech frame (e.g., pitch period for the voiced frame) and $X_{i-1}$ is the speech parameter for the $i-1^{th}$ frame (e.g., pitch period for the voiced frame). The above equation is applied for each of a subsequent voiced frame in the group of the consecutive voiced frames. Further, the error $E_i$ is sent to the next stage. This may continue until the equation is applied to a last voiced frame in the group of consecutive voiced frames. In one embodiment, if the current frame is voiced and the next frame is non-voiced, then the current frame is the last voiced frame. In addition to differentially coding the speech parameters, the voiced frame codebook index may also be differentially coded. Accordingly, the frame data for the speech frame is differentially coded.

After the differential coding of step 480, the method continues to step 490 where entropy coding is performed. In one embodiment, the entropy coding may be Huffman entropy coding. The entropy coding is performed on the differentially coded frame data of the voiced frame (e.g., voiced frame codebook indices, pitch period and gain). The Huffman entropy coding may be applied on the differentially coded frame data of the consecutive voiced frames. In one embodiment, the method 400 may generate Huffman tables offline for the differentially coded frame data based on their associated probabilities. Then, the Huffman table is looked up with the differentially coded frame data as the table index and the associated codeword is fetched for the same. The Huffman table can be constructed for every frame data.

For example, at first, symbol values for a particular differentially coded speech parameter (e.g., pitch period: −16, −15, . . . 0, 15) are identified. Then, associated probability mass function is determined and the symbol probabilities are sorted in a descending order. Further, the least probable two symbols are merged and the resultant symbol is placed in the proper place (sort again). The sorting is continued until two symbols are left. Then, bits (i.e., 0 or 1) are assigned to the above mentioned two symbols. Finally, the tree is traced down by assigning binary bits (i.e., 0 or 1).

After entropy coding, the coded speech frame may be stored in a memory or may be forwarded to a speech decoder for decoding. In some embodiments, the coded speech frame may be transmitted to a speech decoder. For example, the coded speech frame may be transmitted by a mobile telephone. The method 400 then ends in a step 499.

Figure 5:
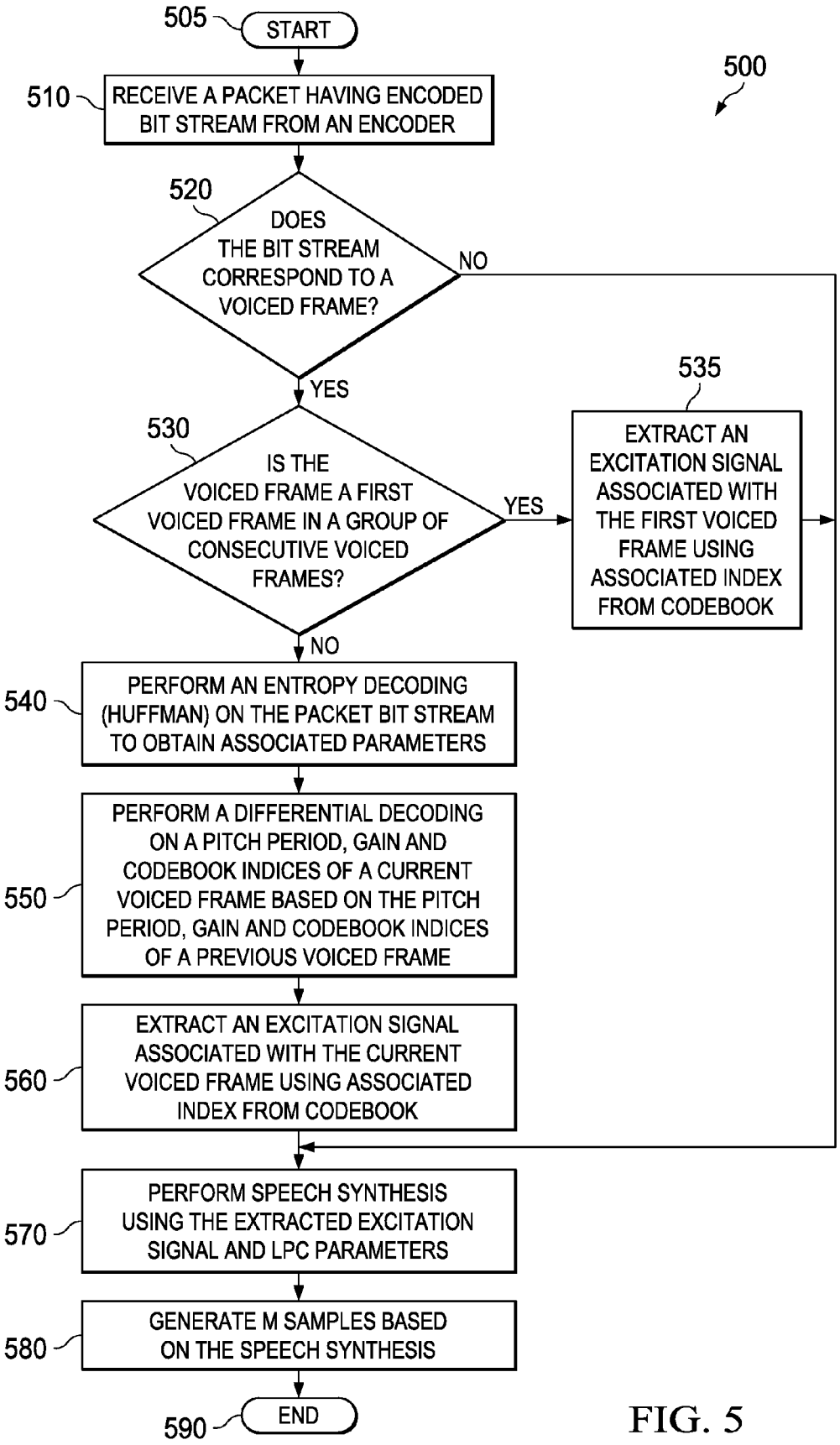
FIG. 5 illustrates a flow diagram of an embodiment of a method of decoding speech carried out according to the principles of the disclosure.

FIG. 5 illustrates a flow diagram of an embodiment of a method 500 of decoding encoded frames carried out according to the principles of the disclosure. The method 500 may decode the encoded frames generated by the method 400. As such, the method 500 may generate M samples from the encoded frames. A decoder, such as the speech decoder 120 of FIG. 1 or the speech decoder 300 of FIG. 3, may be configured to perform the method 500. As such, the speech decoder 120 and the speech decoder 300 may include the necessary circuitry, software, firmware, etc., to perform the steps of the method 500. In one embodiment, the method 500 may be implemented by a mobile phone. The method 500 begins in a step 505.

In a step 510, a packet having an encoded bit stream (e.g., buffer of codeword) is received from an encoder. The encoder may be, for example, the encoder of FIG. 1 or of FIG. 2. The encoded bit stream may be received via a wireless or wired transmitting medium.

In one exemplary implementation, the above-described technique is applied to the low bit rate speech coding standard LPC-10 for the speech parameters, e.g., pitch period, using the property of inter-frame parameter correlation. In accordance with proposed method, a speech encoder stores pitch period and then sends the pitch period in 7 bits when a voiced frame is detected for the first time. For the subsequent voiced frames, the speech encoder sends the difference between the current and previous pitch periods. This difference is always near to zero and is always less than the actual pitch period and hence a less number of bits are required to represent the same. For example, a maximum of 4 bits are required to represent the difference value for the adjacent frames. If any speech frame is found to be unvoiced, then the speech encoder does not send pitch period.

In a first decisional step 520, a determination is made whether the encoded bit stream corresponds to a voiced frame. In one embodiment, the determination may be based on a voiced/unvoiced flag associated with the bit stream. If the encoded bit stream is determined to correspond to a voiced frame, the method 500 continues to a second decisional step 530. Otherwise, the method 500 proceeds to step 280.

In step 530, a determination is made whether the voiced frame is a first voiced frame in a group of consecutive voiced frame. If it is determined so, the method 500 proceeds to step 535; otherwise the method 500 continues to step 540. In operation 535, an excitation signal associated with the first voiced frame is extracted using the associated index from the codebook. The method 500 then proceeds to step 570.

In step 540, an entropy decoding (e.g., Huffman decoding) is performed on the packetized bit stream to obtain frame data. The frame data may include speech parameters such as pitch and gain, and codebook indices. The frame data may also include other parameters associated with voiced frame.

After performing the entropy decoding, differential decoding is performed on the frame data in a step 550. The differential decoding of the frame data of a current voiced frame is based on the frame data of the previous voiced frame.

In step 560, an excitation signal associated with the current voiced frame is extracted using the associated index from the codebook. In step 570, speech synthesis is performed on the current voiced frame using the extracted excitation signal and LPC parameters.

Based on the speech synthesis, M samples are generated in a step 580. The method 500 then ends in a step 590.

Those skilled in the art to which this application relates will appreciate that other and further additions, deletions, substitutions and modifications may be made to the described embodiments.

What is claimed is:

1. A speech encoder, comprising:

a speech frame generator configured to form a speech frame from an input speech signal, said speech frame having a length of multiple samples;

a speech frame processor configured to determine if said speech frame is a subsequent voiced frame of a group of consecutive voiced frames and, based thereon, perform speech analysis of said subsequent voiced frame and further configured to limit a codebook search for said speech frame based on a previous voiced frame codebook index; and a speech frame coder configured to perform, if said speech frame is a subsequent voiced frame, differential coding of speech parameters of said subsequent voiced frame with respect to previous speech parameters of the previous voiced frame of said consecutive voiced frames.

2. The encoder as recited in claim 1 wherein said speech frame coder is further configured to perform entropy coding of said differential coding.

3. The encoder as recited in claim 1 wherein said speech frame processor is further configured to determine a previous voiced frame codebook index.

4. The encoder as recited in claim 1 wherein said speech parameters are pitch period and gain.

5. A decoder, comprising:

a speech sample generator configured to generate multiple speech samples based on a synthesized speech signal;

a speech synthesizer configured to generate said synthesized speech signal from an excitation signal and LPC parameters associated with a subsequent voiced frame of a group of consecutive voiced frames; and a digital speech analyzer configured to perform differential decoding of an encoded bit stream of said subsequent voiced frame to determine said excitation signal and said LPC parameters and further configured to limit a codebook search for said subsequent voiced frame to a region proximate a voiced frame codebook index of a previous received voiced frame of said encoded bit stream.

6. The decoder as recited in claim 5 wherein said digital speech decoder is further configured to perform entropy decoding on said encoded bit stream and thereafter perform said differential decoding.

7. The decoder as recited in claim 6 wherein said digital speech decoder is further configured to extract said excitation signal and said LPC parameters employing a voiced frame codebook index associated with the previous voiced frame of said encoded bit stream.

8. A speech processor, comprising:

an encoder having a speech frame coder configured to perform differential coding of speech parameters of a subsequent voiced frame of a group of consecutive voiced frames, said differential coding based on previous speech parameters of the previous voiced frame of said consecutive voiced frames, said encoder configured to limit a codebook search for said subsequent voiced frame to a region proximate a previous voiced frame codebook index; and a decoder configured to perform differential decoding of an encoded bit stream of a received voiced frame to generate speech samples.

9. The speech processor as recited in claim 8 wherein said encoder is further configured to perform entropy encoding based on said differential encoding.

10. The speech processor as recited in claim 8 wherein said decoder is further configured to perform entropy decoding of said encoded bit stream before performing said differential decoding.

11. The speech processor as recited in claim 8 wherein said received voiced frame is a subsequent voiced frame of a group of consecutive voiced frames encoded in said encoded bit stream.

12. A method of encoding a speech frame, comprising:

determining if a speech frame is a subsequent voiced frame of a group of consecutive voiced frames;

if said speech frame is a subsequent voiced frame, providing differentially coded speech parameters of said subsequent voiced frame with respect to previous speech parameters of the previous voiced frame of said consecutive voiced frames;

limiting a codebook search for said speech frame based on a previous voiced frame codebook index;

entropy coding said differentially coded speech parameters;

generating an encoded bit stream based on said entropy coding.

13. The method as recited in claim 12 wherein said speech parameters are pitch period and gain.

14. A method of decoding an encoded bit stream, comprising:

determining if an encoded bit stream includes a subsequent voiced frame of a group of consecutive voiced frames;

performing entropy decoding of said subsequent voiced frame based on said determining;

performing differential decoding of said subsequent voiced frame based on said entropy decoding;

limiting a codebook search for said subsequent voiced frame to a region proximate a voiced frame codebook index of a previous received voiced frame of said encoded bit stream; and generating multiple speech samples of said subsequent voiced frame based on said entropy and differential decoding.

15. The method of decoding as recited in claim 14 further comprising determining an excitation signal and LPC parameters based on said entropy and differential decoding.

16. The method of decoding as recited in claim 15 further comprising generating a synthesized speech signal from said excitation signal and said LPC parameters, wherein said multiple speech samples are generated based thereon.

17. A speech processor, comprising:

an encoder having a speech frame coder configured to perform differential coding of speech parameters of a subsequent voiced frame of a group of consecutive voiced frames, said differential coding based on previous speech parameters of the previous voiced frame of said consecutive voiced frames; and a decoder configured to perform differential decoding of an encoded bit stream of a received voiced frame to generate speech samples and further configured to limit a codebook search for a received subsequent voiced frame to a region proximate a voiced frame codebook index of a previous received voiced frame of said encoded bit stream.

18. The speech processor as recited in claim 17 wherein said encoder is further configured to perform entropy encoding based on said differential encoding.

19. The speech processor as recited in claim 17 wherein said decoder is further configured to perform entropy decoding of said encoded bit stream before performing said differential decoding.

20. The speech processor as recited in claim 17 wherein said received voiced frame is a subsequent voiced frame of a group of consecutive voiced frames encoded in said encoded bit stream.

* * * * *